US008631775B2

(12) United States Patent
Klingbeil

(10) Patent No.: US 8,631,775 B2
(45) Date of Patent: Jan. 21, 2014

(54) MULTI-MODE VALVE CONTROL MECHANISM FOR CAM-DRIVEN POPPET VALVES

(75) Inventor: Adam Edgar Klingbeil, Ballston Lake, NY (US)

(73) Assignee: General Electric Company, Niskayuna, NY (US)

( * ) Notice: Subject to any disclaimer, the term of this patent is extended or adjusted under 35 U.S.C. 154(b) by 588 days.

(21) Appl. No.: 12/845,214

(22) Filed: Jul. 28, 2010

(65) Prior Publication Data

US 2012/0024246 A1 Feb. 2, 2012

(51) Int. Cl.
*F01L 1/18* (2006.01)

(52) U.S. Cl.
USPC ..... 123/90.44; 123/90.16; 123/90.39; 74/569

(58) Field of Classification Search
USPC ..... 123/90.16, 90.39, 90.44; 74/569
See application file for complete search history.

(56) References Cited

U.S. PATENT DOCUMENTS 4,535,732 A 8/1985 Nakano et al.
4,741,297 A 5/1988 Nagahiro et al.
5,031,583 A 7/1991 Konno
5,280,770 A 1/1994 Satou et al.
5,469,818 A 11/1995 Yoshioka et al.
5,694,894 A 12/1997 Allen
5,782,216 A * 7/1998 Haas et al. ..... 123/90.16
6,076,491 A 6/2000 Allen
7,255,075 B2 8/2007 Cornell et al.
7,347,171 B2 3/2008 Leman et al.

FOREIGN PATENT DOCUMENTS

WO 91/12413 8/1991

* cited by examiner

*Primary Examiner* — Ching Chang
(74) *Attorney, Agent, or Firm* — Joseph J. Christian

(57) ABSTRACT

A multi-mode valve control mechanism for an engine includes a primary cam follower rotatably mounted within a mount and having one end engaging a camshaft. One or more secondary cam followers are rotatably mounted within the mount and having one end engaging the camshaft. Each secondary cam follower is operatively coupled to a shaft. A follower is dedicated to each cam lobe. A frequency and a duration at which valves in a valve train are actuated is changed by activating only the primary cam follower in a first mode of operation, or activating both the primary cam follower and the one more than one secondary cam followers in a second mode of operation, depending on whether the control mechanism has been activated or not. In either mode of operation, the entire valve train assembly is actuated.

12 Claims, 14 Drawing Sheets

MULTI-MODE VALVE CONTROL MECHANISM FOR CAM-DRIVEN POPPET VALVES

BACKGROUND OF THE INVENTION

Four stroke diesel cycle internal combustion engines are well known. One of ordinary skill in the art will readily recognize that such engines operate through four distinct strokes of a piston reciprocating within a cylinder. In an intake stroke, the piston descends within the cylinder while an intake valve is open. Air is thereby able to enter the cylinder through the open intake valve. In a subsequent compression stroke, the piston reverses direction while the intake valve and an exhaust valve are closed, thereby compressing the air. This is followed by a combustion or power stroke wherein the fuel is directly injected into the compressed air and thereby ignited, with the resulting force pushing the piston again in the descending direction while both valves are closed. Finally, the piston reverses direction with the exhaust valve open, thereby pushing the combustion gases out of the cylinder.

Various types of valve timing schemes have been developed, for example, U.S. Pat. Nos. 4,535,732, 5,031,583, 5,280,770, 5,469,818, 7,055,472, 7,069,887, 7,255,075 and 7,347,171. Many of these patents use hydraulics to hold the valve mechanisms in place or use cam phasors to shift the phase of the cam relative to the crankshaft.

However, the optimized valve events for some operating conditions are not necessarily optimized over the entire operating range. In particular, valve strategies that have been investigated more recently, including Miller cycle strategies, can provide very good performance over a range of conditions, but some conditions, and in particular low to medium load, suffer from poor airflow.

BRIEF SUMMARY OF THE INVENTION

In general, the invention modifies the basic operating principle of cam-driven valves on a reciprocating engine to enable the valve train to follow either a primary cam lobe (similar to a conventional valve train) in one mode of operation when the system is de-activated, or the superposition of the primary cam lobe and at least one secondary cam lobe in another mode of operation when the system is activated. In this manner, the invention always actuates (i.e., opens and closes) the same number of valves. Rather, the invention changes the frequency, the duration, or both frequency and duration at which the valves are actuated using either one cam lobe (i.e., primary cam lobe) or more than one cam lobe (i.e., primary and one or more secondary cam lobes), depending on whether the system is activated or not, and in accordance with a specific operating condition of the engine.

By activating additional valve events with one or more secondary cam lobes at the appropriate time (i.e, frequency) and duration, the invention solves a variety of problems associated with optimizing valve events for certain operation conditions of an internal combustion engine. For example, the problem of rapid catalyst heat-up is solved by activating a secondary valve event during cold start conditions that causes the exhaust valve to open during the expansion stroke, thereby releasing hotter exhaust gases into the exhaust stream. Additional fuel may also be injected during this time to further increase the rate of heating of the catalyst.

The problem of turbine acceleration during transients is solved by activating a secondary valve event during acceleration that causes the exhaust valve to open during the expansion stroke, releasing hotter exhaust gases at higher pressures into the exhaust stream, thereby putting more energy into the turbocharger, and increasing boost at a faster rate than conventional engines. Additional fuel may be injected during this time to further increase the amount of energy supplied to the turbine.

The problem of switching between aggressive Miller cycle and non-aggressive Miller cycle or aggressive Miller cycle and normal diesel cycle is solved by activating a secondary valve event to hold the intake valve open longer than the primary valve event alone or by activating a secondary valve event during the early part of the compression stroke.

The problem of switching between negative valve overlap operation for some conditions and standard operation (no negative valve overlap operation) for other conditions is solved by activating a secondary valve event to cause an overlap between the exhaust valve event and the intake valve event where the primary valve event is designed for negative valve overlap.

In one aspect, a multi-mode valve control mechanism comprises a primary cam follower rotatably mounted within a mount and having one end engaging a camshaft; one or more secondary cam followers rotatably mounted within a mount and having one end engaging the camshaft, each secondary follower including means for coupling and decoupling to the primary cam follower; and means for exerting a biasing force on the secondary cam followers. In a first mode of operation, the primary cam follower is not operatively coupled to the one or more secondary cam followers in such a way that actuation of the one or more secondary cam followers will not actuate the primary cam follower. In a second mode of operation, the locking pins are disposed within the cavity and the primary cam follower is operatively coupled to the secondary cam followers in such a way that actuation of the secondary cam followers will also actuate the primary cam follower.

In another aspect, a multi-mode valve control mechanism for an engine comprises a primary cam follower rotatably mounted within a mount and having one end engaging a camshaft; one or more secondary cam followers rotatably mounted within the mount and having one end engaging the camshaft, each secondary cam follower operatively coupled to a shaft; and a biasing member disposed between the mount and a seat for exerting a biasing force therebetween. A frequency and a duration at which valves in a valve train are actuated is changed by activating only the primary cam follower in a first mode of operation, or activating both the primary cam follower and one more than one secondary cam followers in a second mode of operation, depending on whether the coupling mechanism has been activated.

In another aspect, a method of modulating a valve event in an engine using a multi-mode valve control mechanism comprises changing one of a frequency and a duration at which valves in a valve train are actuated by activating only a primary cam follower in a first mode of operation, or activating both the primary cam follower and at least one secondary cam followers in a second mode of operation, depending on whether the at least one secondary cam follower is decoupled or coupled to the primary cam follower, respectively.

DETAILED DESCRIPTION OF THE INVENTION

Figure 15:
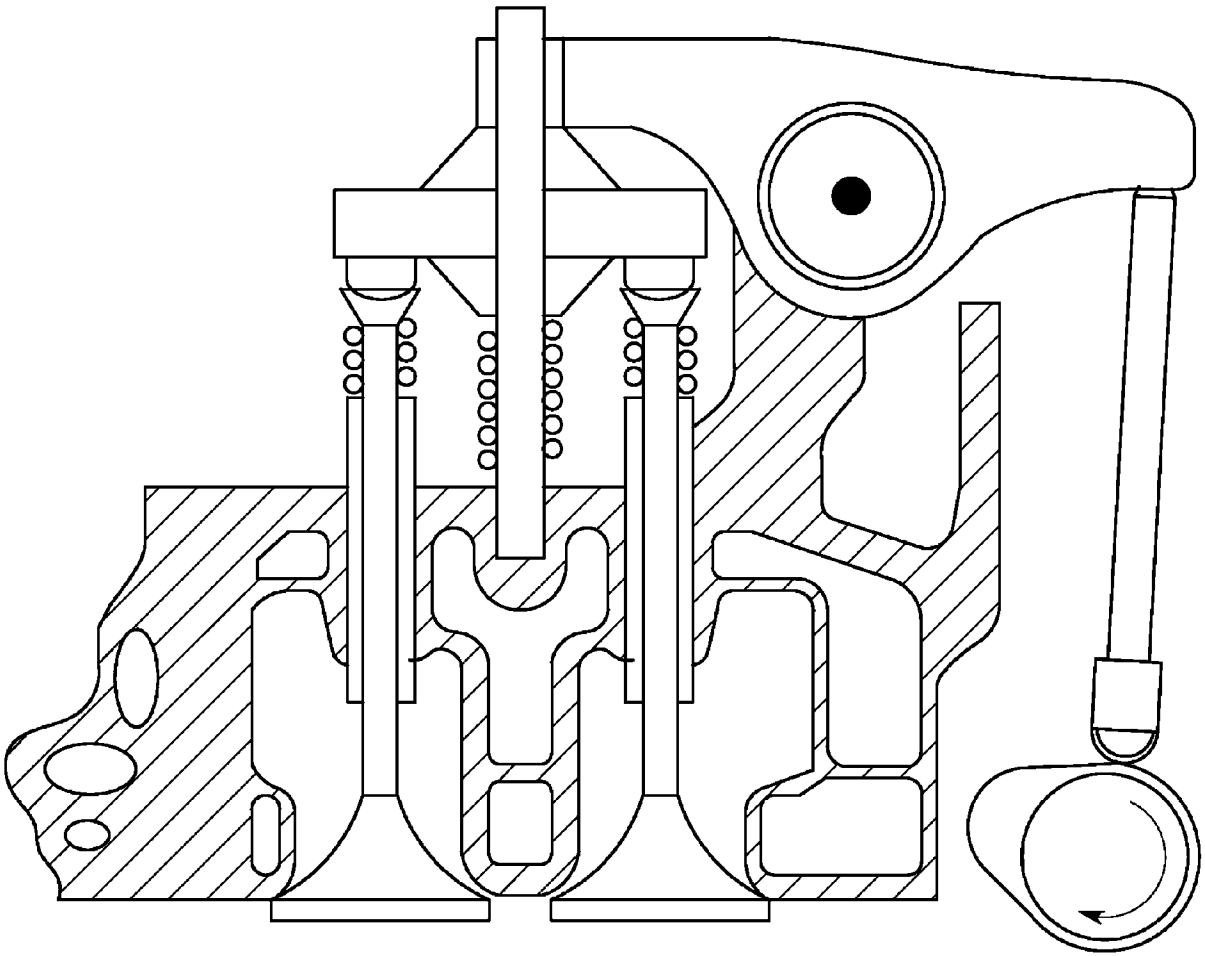
FIG. 15(PRIOR ART)
FIG. 15 is a plan view of a valve train actuated by a cam mechanism on a typical four-stroke diesel cycle internal combustion engine when a cam follower is in contact with the base circle of the camshaft and the poppet valves are closed.

To describe how the invention works, it may be useful to first describe the basic operating principle of a valve train actuated by a cam mechanism on a typical four-stroke diesel cycle internal combustion engine. When the cam follower is in contact with the base circle of the camshaft, the poppet valves are closed, as shown in FIG. 15. As the cam rotates, the cam lobe pushes on the follower, which in turn actuates the push rod, actuating the rocker arm and causing the valves to open, as shown in FIG. 16.

Figure 16:
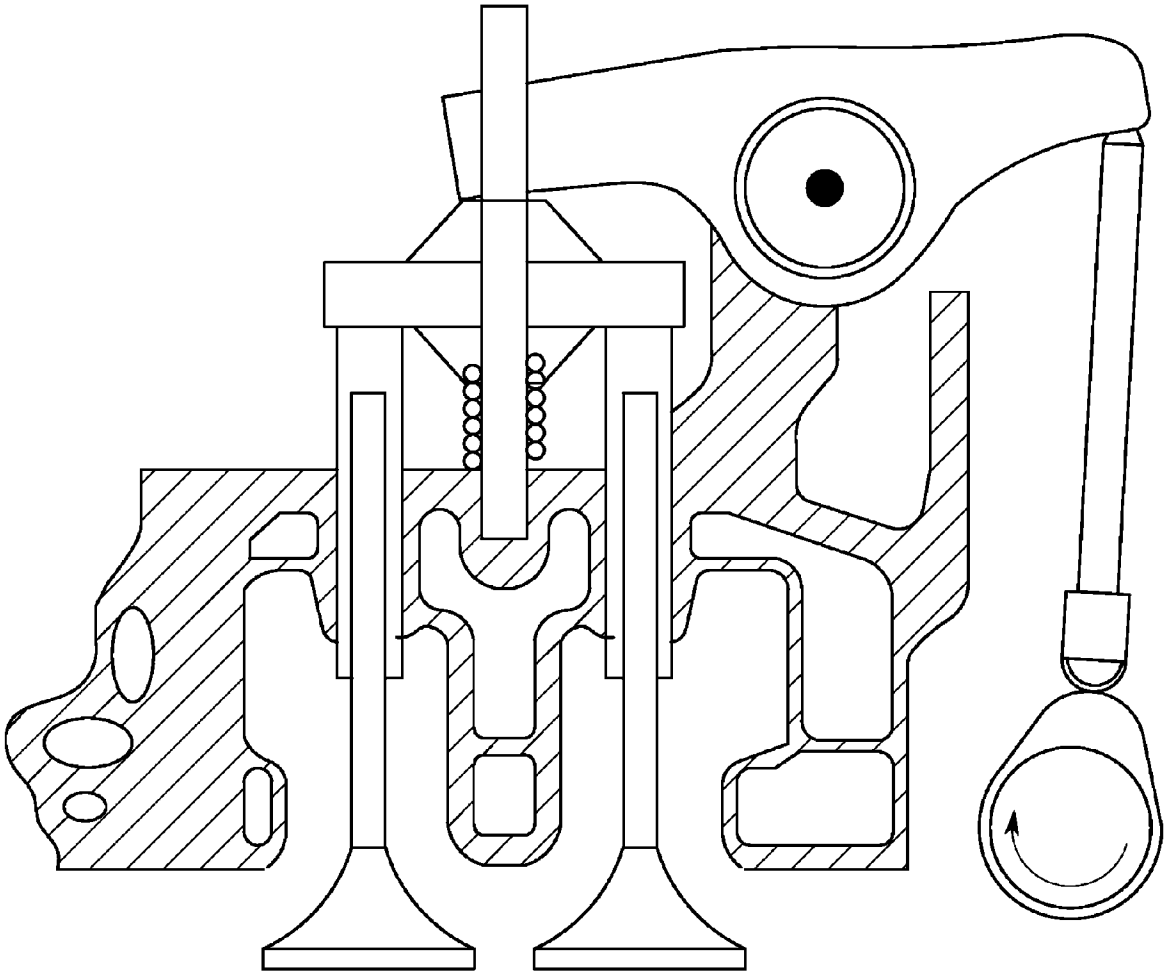
FIG. 16(PRIOR ART)
FIG. 16 is a plan view of the valve train actuated by a cam mechanism on a typical four-stroke diesel cycle internal combustion engine when the cam follower is in contact with the lobe of the camshaft and the poppet valves are open.

The invention described herein is a modification to the engine of FIGS. 15 and 16 to enable the valve train to follow either one cam lobe (as show schematically above) or the superposition of two cam lobes. Although a four-stroke diesel cycle internal engine is generally described herein, it is to be understood that the teachings of the invention can be employed in conjunction with other devices that utilize cam-driven valves, such as, for example, two-stroke engines and gasoline engines.

Figure 2:
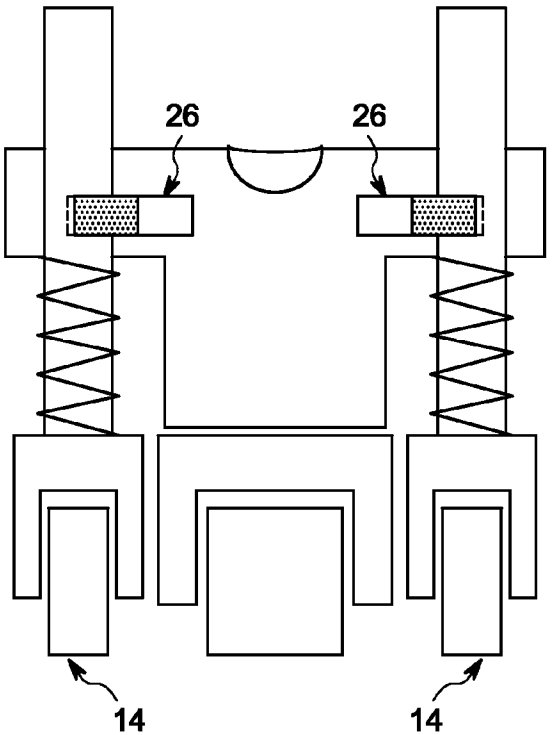
FIG. 2 is a plan view of the two-mode valve control mechanism of FIG. 1 when the secondary cam followers are actuated by locking pins and the cam followers are in contact with the base circle of the camshaft.
Figure 1:
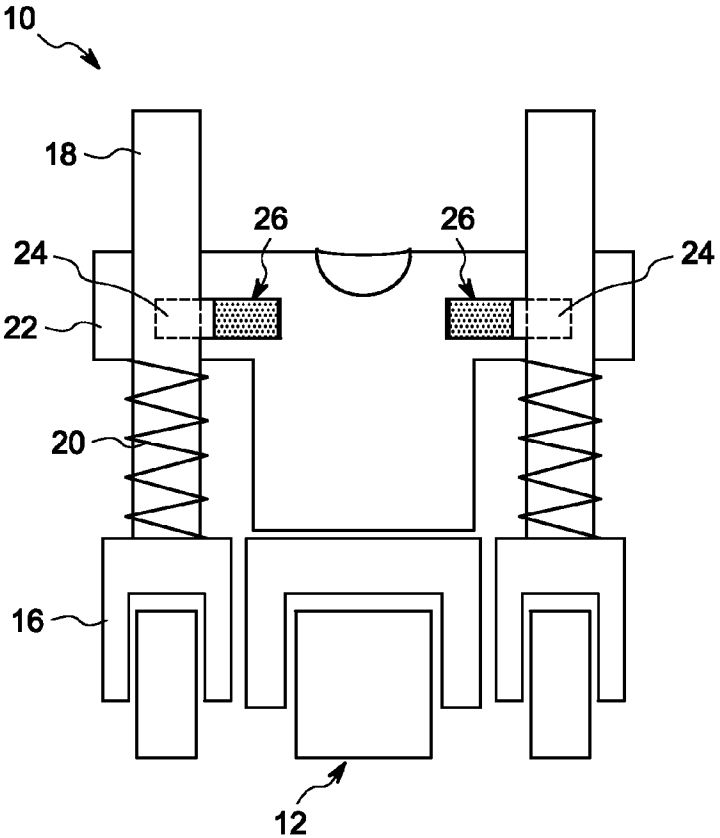
FIG. 1 is a plan view of a two-mode valve control mechanism with one primary cam follower and two secondary cam followers according to an embodiment of the invention when the secondary cam followers are not actuated by locking pins and the cam followers are in contact with the base circle of the camshaft.

Referring now to FIGS. 1 and 2, a two-mode valve control mechanism 10 is shown according to an embodiment of the invention. The mechanism 10 includes a primary cam follower 12 and one or more secondary cam followers 14. The cam lobe which drives the primary cam follower 12 can have the same profile as the cam lobe which drives the secondary cam followers 14, or the cam lobe which drives the primary cam follower 12 can have a different profile than one or more of the secondary cam followers 14. In the illustrated embodiment, a pair of secondary cam followers 14 is shown. However, the number of secondary cam followers 14 does not limit the invention, and that the invention can be practiced with one or more cam secondary followers 14. Each of the cam followers 14 may follow cam profiles that are individually defined and may or may not be the same as any of the other cam profiles. Each of the cam followers 12, 14 are rotatably mounted within a mount 16. A shaft 18 is operably coupled to the mount 16 for each of the secondary cam followers 14. A biasing member 20, such as a compression spring and the like, is disposed about each of the shafts 18 and positioned between the mount 16 and a seat 22 for a push rod (FIGS. 15 and 16) to provide a means for exerting a biasing force on the secondary cam followers 14. Each shaft 18 includes a bore or cavity 24 for receiving a locking pin 26. In this embodiment, the cavity 24 and the locking pin 26 provide a means for coupling and decoupling the secondary cam followers 14 and shaft 18 to the primary cam follower 12.

The secondary cam followers 14 are disabled (decoupled with the primary cam follower 12) when the locking pins 26 are not inserted into the cavity 24 of the shaft 18, as shown in FIG. 1. In this first operating mode, the primary cam follower 12 is not operatively coupled to the secondary cam followers 14, and the secondary cam followers 14 can move vertically without causing the primary cam follower 12 to move. In other words, in the first mode of operation, the locking pins 26 are not disposed within the cavity 24 and the primary cam follower 12 is not operatively coupled (decoupled) to the secondary cam followers 14 in such a way that actuation of the secondary cam followers 14 will not actuate the primary cam follower 12. Thus, actuation of the secondary cam followers 14 by the secondary cam lobe will not cause the mechanism 10 to be actuated and the push rod to move.

Oppositely, the secondary cam followers 12 are enabled (coupled to the primary cam follower 12) when one or both locking pins 26 are inserted into the cavity 24 of the shaft 18, as shown in FIG. 2. In this second operating mode, the locking pins 26 are actuated which fix the position of the secondary cam followers 14 relative to the primary cam follower 12. In other words, in the second mode of operation, the locking pins 26 are disposed within the cavity 24 and the primary cam follower 12 is operatively coupled to the secondary cam followers 14 in such a way that actuation of the secondary cam followers 14 will also actuate the primary cam follower 12. Thus, actuation of either one of the primary or secondary cam followers 12, 14 by a cam lobe will cause actuation of the mechanism 10 and movement of the push rods.

Figure 3:
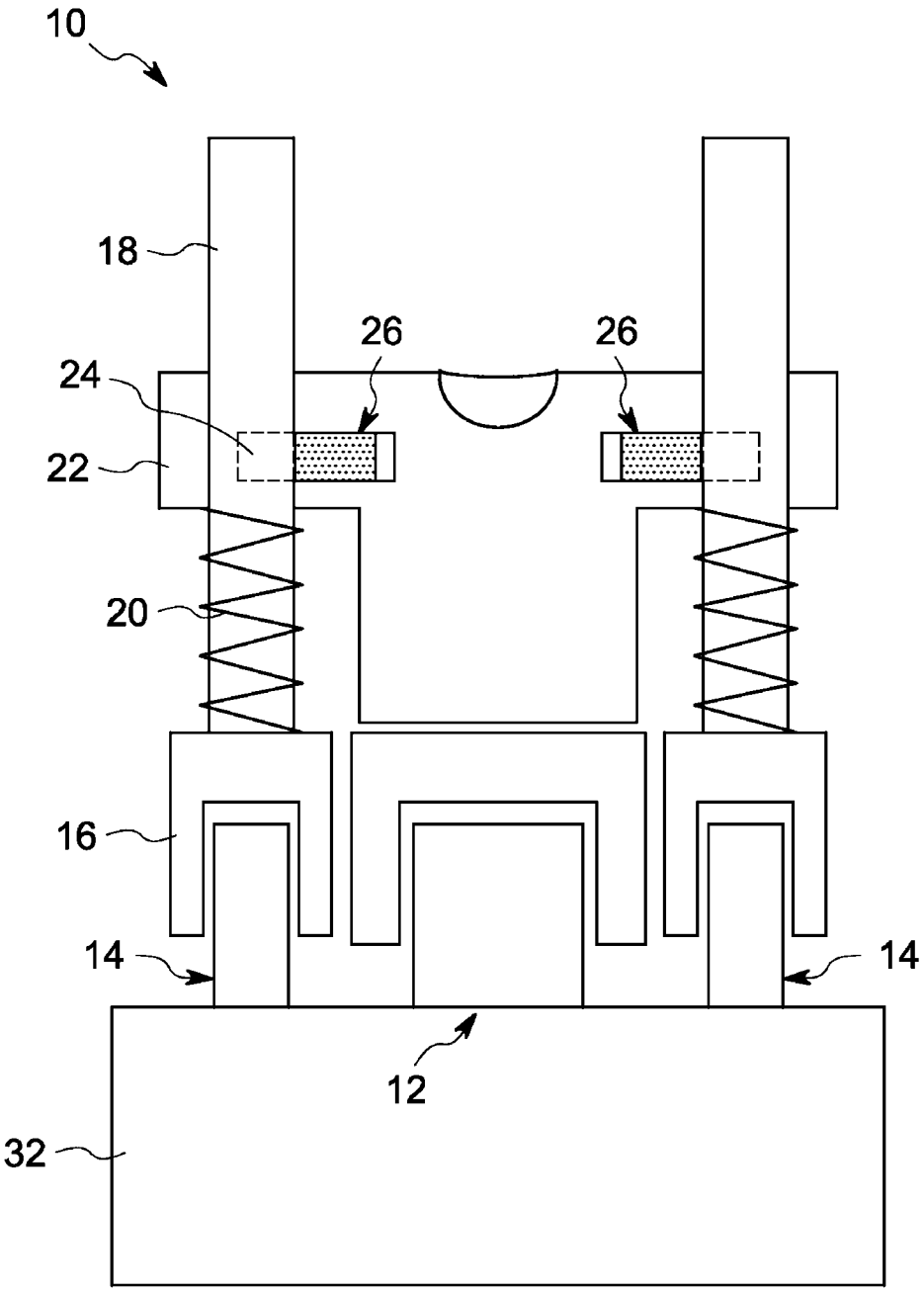
FIG. 3 is a plan view of the two-mode valve control mechanism of FIG. 1 when the secondary cam followers are not actuated by locking pins and the primary and secondary cam followers are in contact with the base circle of the camshaft.
Figure 4:
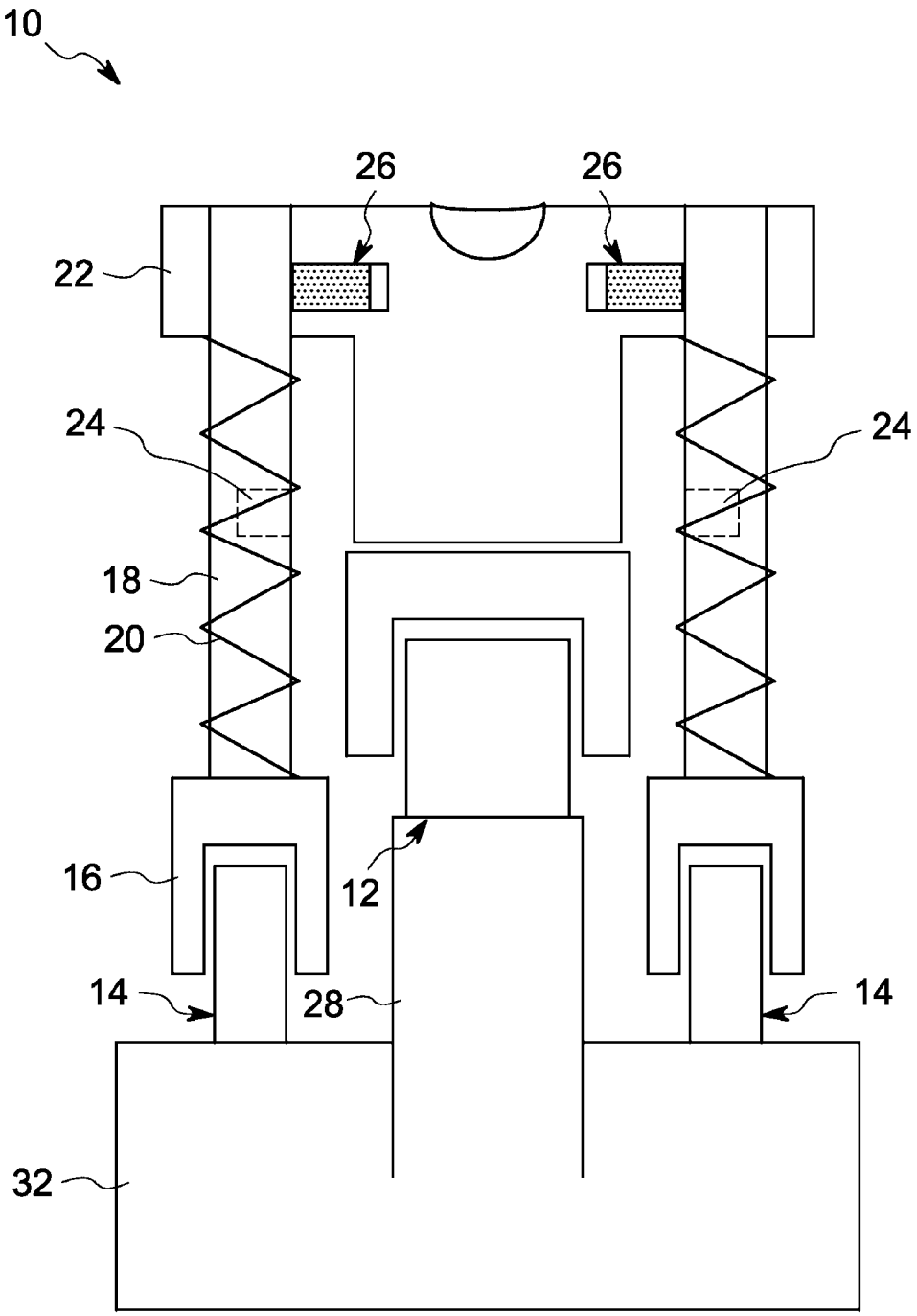
FIG. 4 is a plan view of the two-mode valve control mechanism of FIG. 3 when the secondary cam followers are not actuated by locking pins and the primary cam follower is in contact with the lobe of the camshaft and the secondary cam followers are in contact with the base circle of the camshaft.
Figure 5:
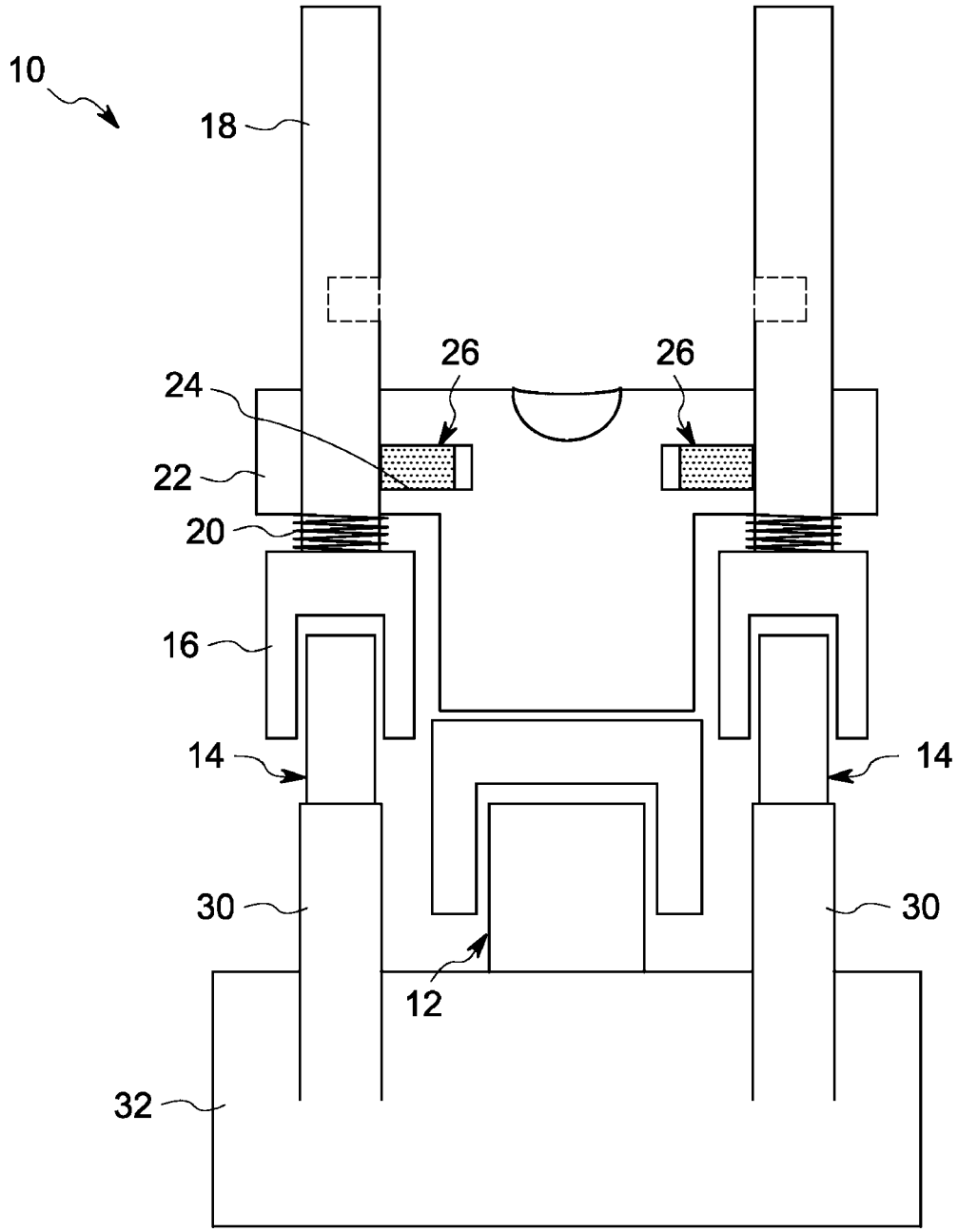
FIG. 5 is a plan view of the two-mode valve control mechanism of FIG. 3 when the secondary cam followers are not actuated by locking pins and the primary cam follower is in contact with the base circle of the camshaft and the secondary cam followers are in contact with the lobe of the camshaft.

More details about the operation of the mechanism 10 will now be described. FIGS. 3-5 illustrate how the mechanism 10 operates in the first mode of operation when the secondary cam followers 14 are disabled, i.e., the locking pins 26 are not inserted into the cavity 24 of the shaft 18.

In FIG. 3, a primary cam lobe 28 and secondary cam lobes 30 (not visible in FIG. 3) are in contact with the base circle of a camshaft 32. In this position, both the primary cam follower 12 and the secondary cam followers 14 are at the same vertical position.

In FIG. 4, the primary cam lobe 28 actuates the primary cam follower 12. As a result, the primary cam follower 12 is moved in the vertical direction and the push rod actuates the valve train (FIG. 1). In this position, the primary cam follower 12 is in a different vertical position as the secondary cam followers 14. It is noted that the secondary cam followers 14 maintain contact with the camshaft 32 because of the biasing force exerted by the springs 20 on the secondary cam followers 14. It will be appreciated that the invention is not limited by the springs 20 being disposed about the shaft 18, and that the invention can be practiced with the springs 20 positioned in any desirable location that provides an adequate biasing force on the secondary cam followers 14 such that the secondary cam followers 14 maintain contact with the camshaft 32.

In FIG. 5, the secondary cam lobes 30 actuate the secondary cam followers 14 and the secondary cam followers 14 move in the vertical direction, while the primary cam follower 12 maintains contact with the base circle of the camshaft 32. In this position, the secondary cam followers 14 are in a different vertical position as the primary cam follower 12. This contact is maintained because the secondary cam followers 14 move freely with respect to the primary cam follower 12, while biasing forces in the valve train act against any vertical movement of the primary cam follower 12.

Figure 6:
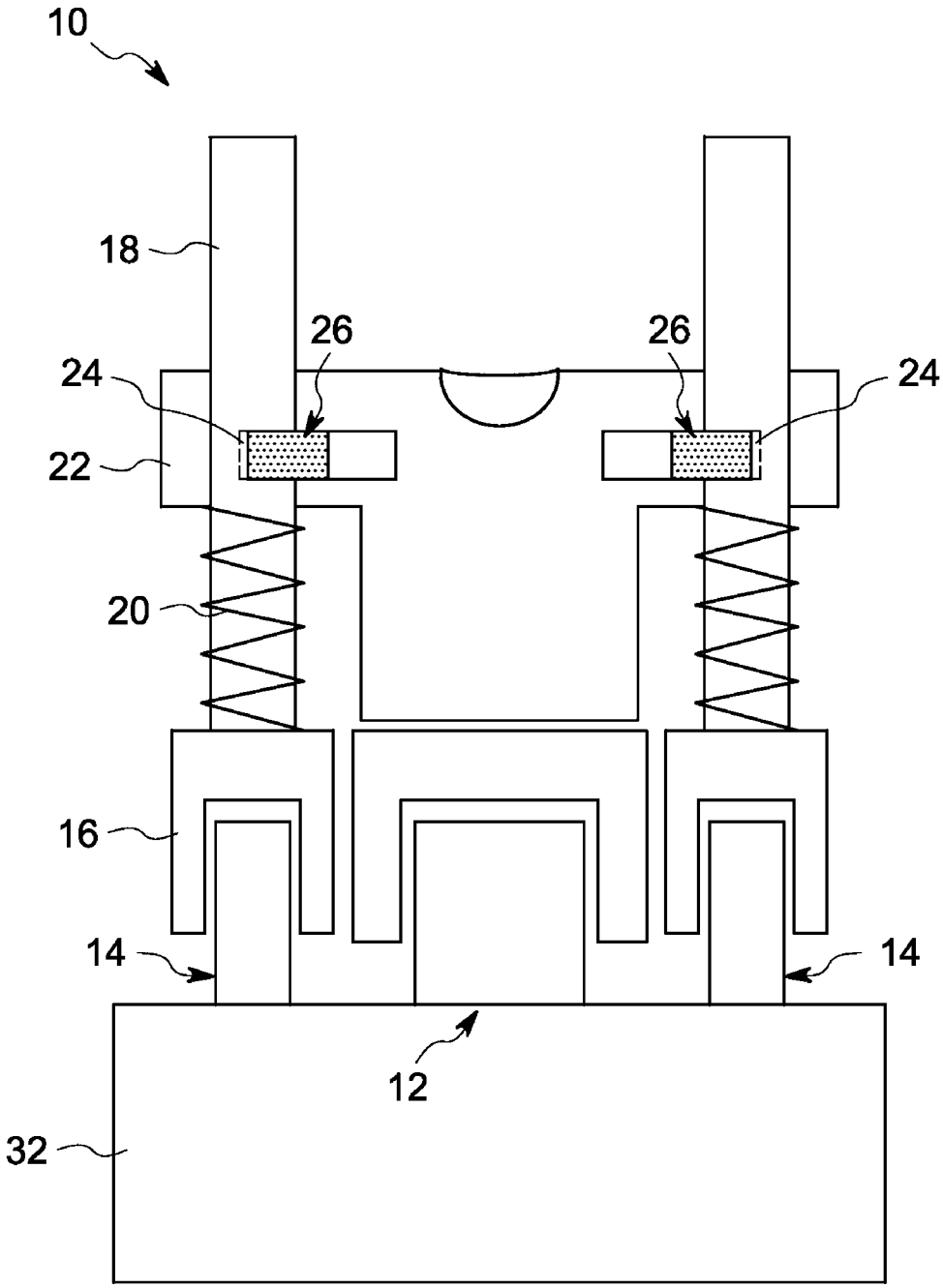
FIG. 6 is a plan view of the two-mode valve control mechanism of FIG. 1 when the secondary cam followers are actuated by locking pins and the primary and secondary cam followers are in contact with the base circle of the camshaft.
Figure 7:
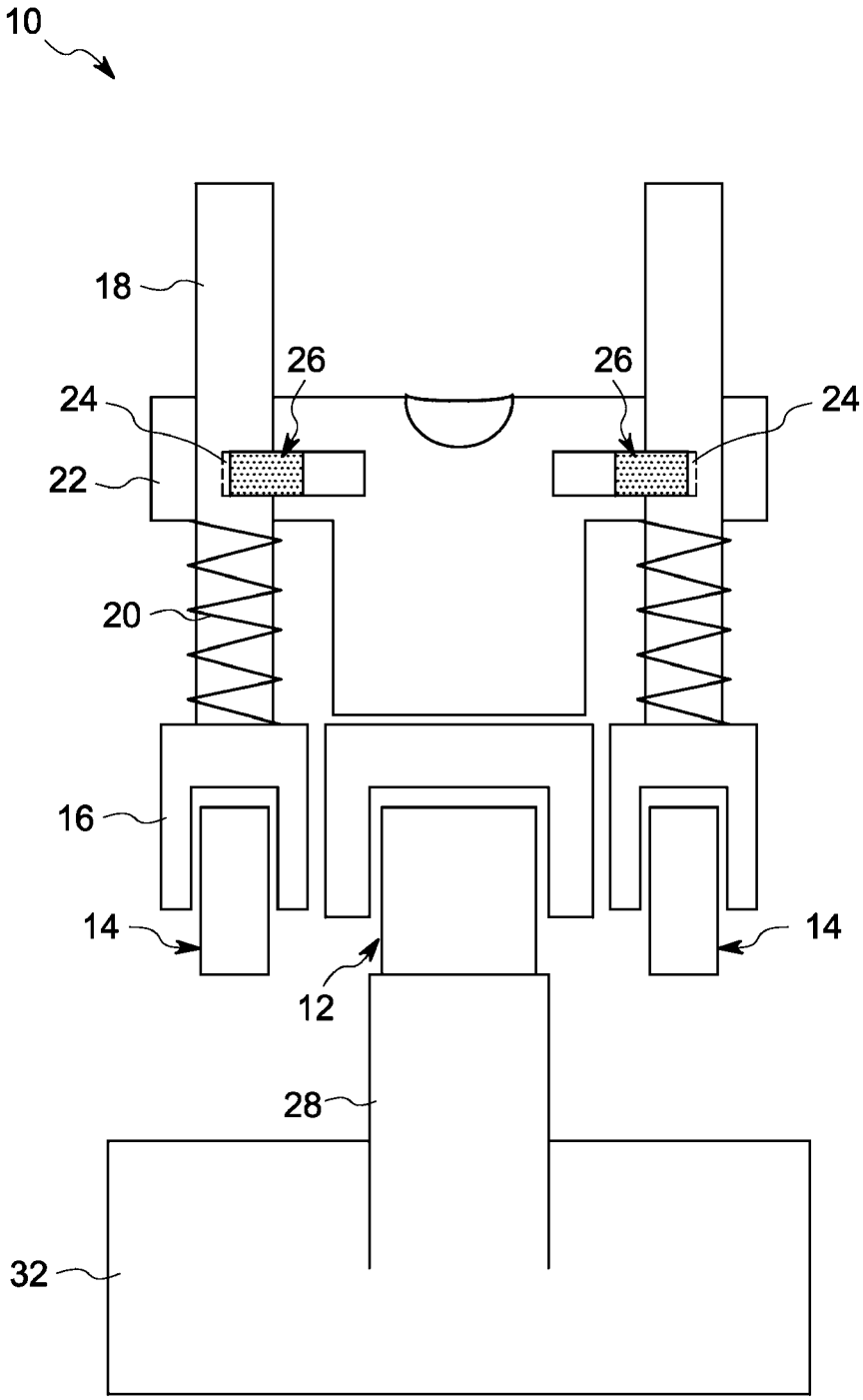
FIG. 7 is a plan view of the two-mode valve control mechanism of FIG. 6 when the secondary cam followers are actuated by locking pins and the primary cam follower is in contact with the lobe of the camshaft and the secondary cam followers are in contact with the base circle of the camshaft.
Figure 8:
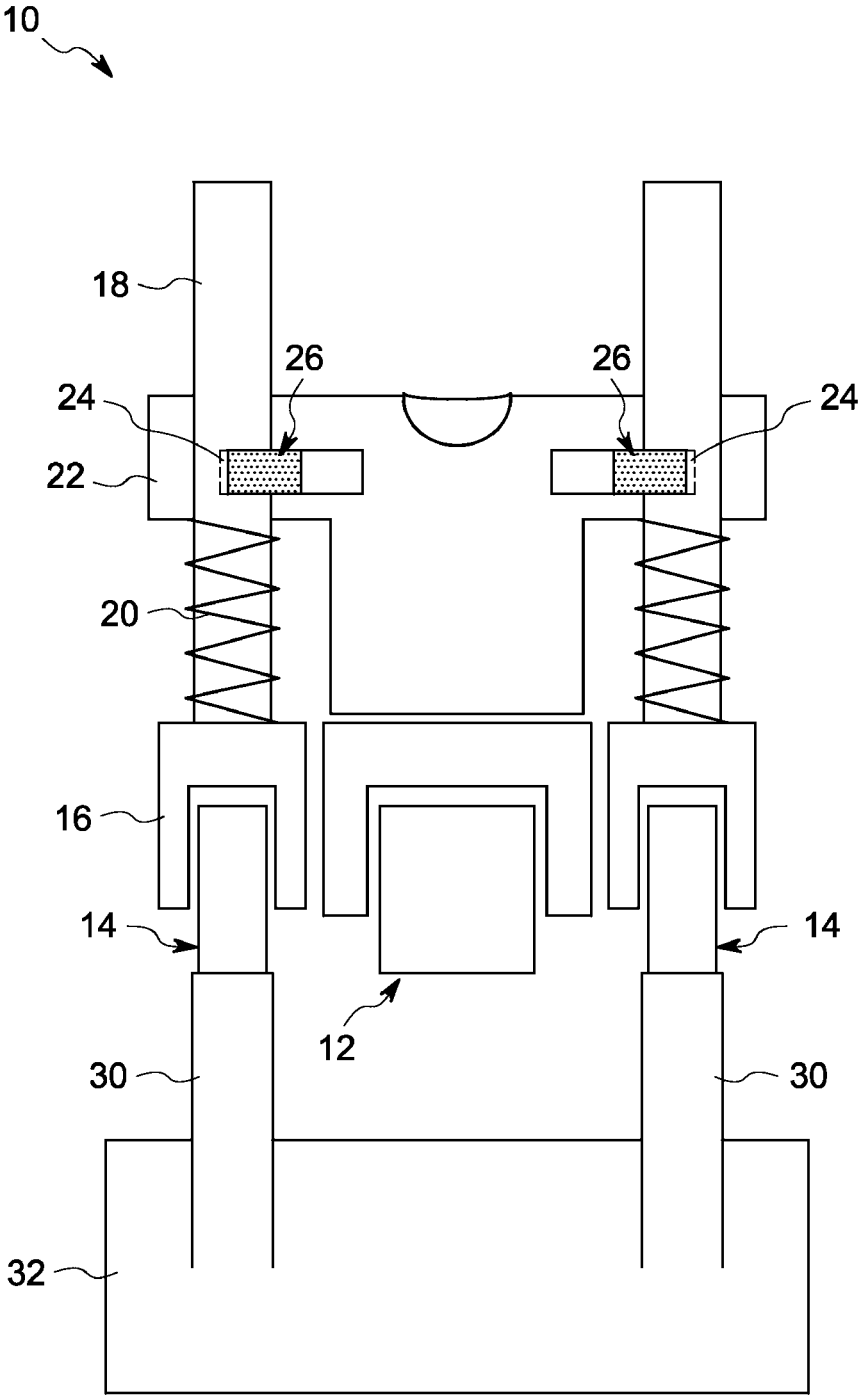
FIG. 8 is a plan view of the two-mode valve control mechanism of FIG. 6 when the secondary cam followers are actuated by locking pins and the primary cam follower is in contact with the base circle of the camshaft and the secondary cam followers are in contact with the lobe of the camshaft.

FIGS. 6-8 illustrate how the mechanism 10 operates in the second mode of operation when the secondary cam followers 14 are enabled, i.e., the locking pins 26 are at least partially disposed within the cavity 24 of their respective shaft 18. When the locking pins 26 are activated, the secondary cam followers 14 are directly linked to the primary cam follower 12.

In FIG. 6, the primary cam lobe 28 and the secondary cam lobes 30 (not visible in FIG. 6) are in contact with the base circle of a camshaft 32. In this position, both the primary cam follower 12 and the secondary cam followers 14 are at the same vertical position. The first picture illustrates the followers when they are all at the cam base circle.

In FIG. 7, the primary cam lobe 28 actuates the primary cam follower 12. Because the locking pins 26 are situated in the cavity 24 to couple the primary and second cam followers 12, 14, the secondary cam followers 14 are also lifted with the primary cam follower 12. In this position, both the primary cam follower 12 and the secondary cam followers 14 are at the same vertical position.

In FIG. 8, the secondary cam lobe 30 actuates the secondary cam followers 14. Because the locking pins 26 are situated in the cavity 24 to link the primary and second cam followers 12, 14, the primary cam follower 12 is also lifted with the secondary cam followers 14. In this position, both the primary cam follower 12 and the secondary cam followers 14 are at the same vertical position. As a result, the valve train is actuated a second time in the second mode operation when the locking pins 26 actuate the secondary cam followers 14, as compared to the first mode of operation in which the locking pins 26 did not actuate the secondary cam followers 14 and the valve train was not actuated by the secondary cam followers 14.

Figure 10:
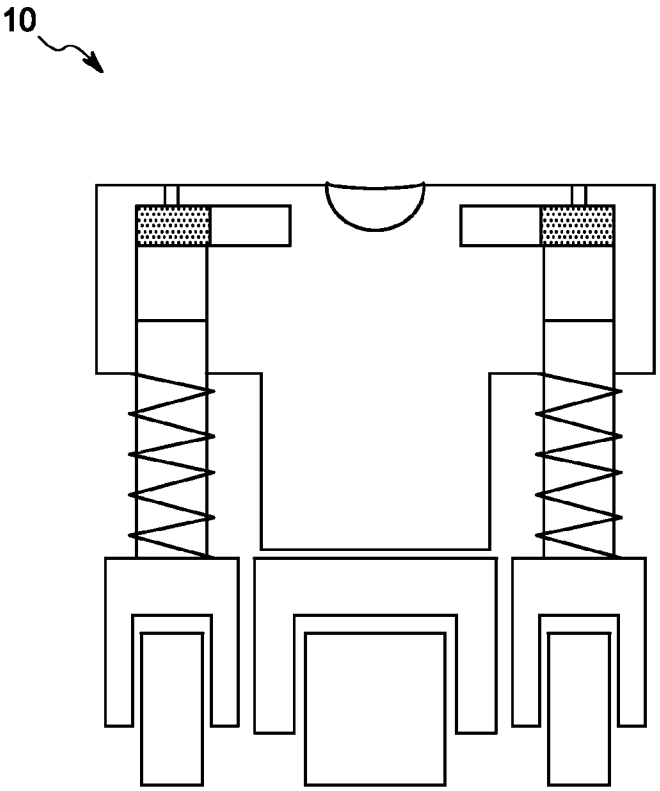
FIG. 10 is a plan view of a two-mode valve control mechanism with one primary cam follower and two secondary cam followers according to an alternate embodiment of the invention when the locking pins are hydraulically actuated and the cam followers are in contact with the base circle of the camshaft.
Figure 9:
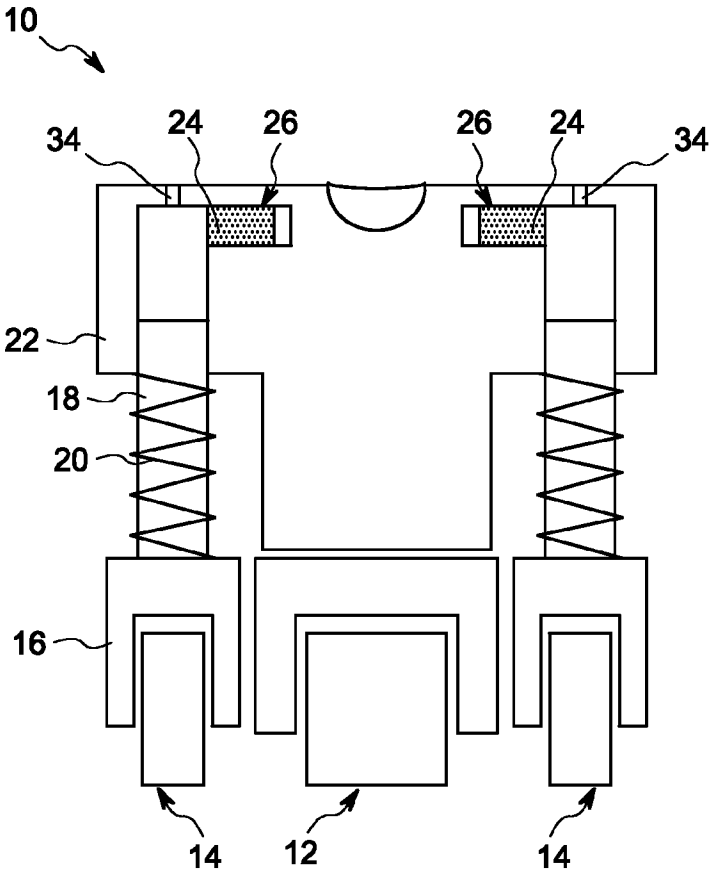
FIG. 9 is a plan view of a two-mode valve control mechanism with one primary cam follower and two secondary cam followers according to an alternate embodiment of the invention when the locking pins blocks an oil relief port so that the secondary cam followers are in hydraulic communication with the primary cam followers, and the cam followers are in contact with the base circle of the camshaft.

The locking pins 26 may be actuated (inserted into their respective cavity 24) using a variety of different means known in the art. In the above-mentioned embodiment of the mechanism 10, the locking pins 26 are actuated by mechanical means, such as springs, and the like. FIGS. 9 and 10 illustrate another embodiment of the mechanism 10 in which the secondary cam followers are enabled by hydraulic means. In this design, the cavity 24 is filled with a fluid, such as engine oil, and the like, and a weep hole 34 is in fluid communication with the cavity 24. In the illustrated embodiment, the weep hole 34 is located at one end of the cavity 24. However, it will be appreciated that the weep hole 34 can be located at any desirable location along the cavity 24, so long as the weep hole 34 is in fluid communication therewith.

When the secondary cam lobes are deactivated, as shown in FIG. 9, the shaft 18 of the secondary cam followers 14 pushes the oil through the weep hole 34 at a relatively low pressure. In order to activate the secondary cam followers 14, the locking pin 26 blocks the weep hole 34, as shown in FIG. 10. Then, when the shaft 18 attached to the secondary cam followers 14 attempts to move vertically, the oil is compressed, causing the primary cam lobe 28 to rise with the secondary cam lobes 30.

It will be appreciated that the invention is not limited by the means for activating the secondary cam followers 14 with the locking pins 26. For example, the locking pins 26 can actuate the secondary cam followers 14 using pneumatic pressure, electromagnetic, electromechanical, and the like. For example, the secondary cam followers can be enabled by a solenoid, which is an electromechanical means.

As mentioned above, the valve control mechanism 10 of the invention can be used to solve a variety of different problems associated with conventional valve control mechanisms by modulating valve events for a particular operating condition of the internal combustion engine.

Figure 11:
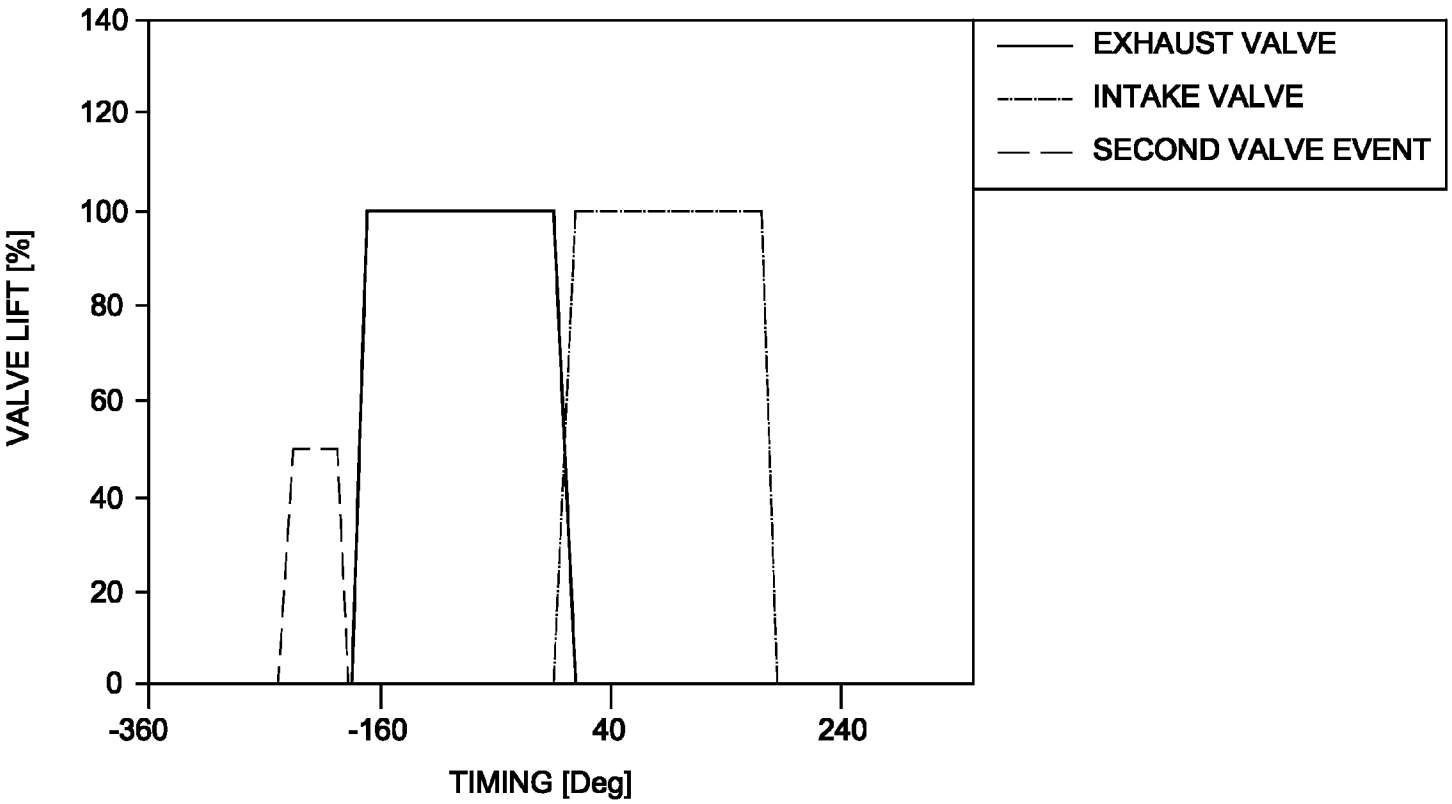
FIG. 11 is a graph illustrating a valve control strategy for rapid catalyst heat-up using the two-mode valve control mechanism of the invention by activating a secondary valve event during cold start conditions that causes the exhaust valve to open during the expansion stroke, thereby releasing hotter exhaust gases into the exhaust stream.

For example, the problem of rapid catalyst heat-up is solved by activating a secondary valve event during cold start conditions that causes the exhaust valve to open during the expansion stroke, thereby releasing hotter exhaust gases into the exhaust stream, as shown in FIG. 11. Additional fuel may also be injected during this time to further increase the rate of heating of the catalyst. This also applies to the problem of heating or regenerating diesel particulate filters and flow-through filters Similarly, the problem of turbine acceleration during transients is solved by activating a secondary valve event during acceleration that causes the exhaust valve to open during expansion the stroke, releasing hotter exhaust gases into the exhaust stream, thereby putting more energy into the turbocharger, and increasing boost. Additional fuel may be injected during this time to further increase the amount of energy supplied to the turbine.

Figure 12:
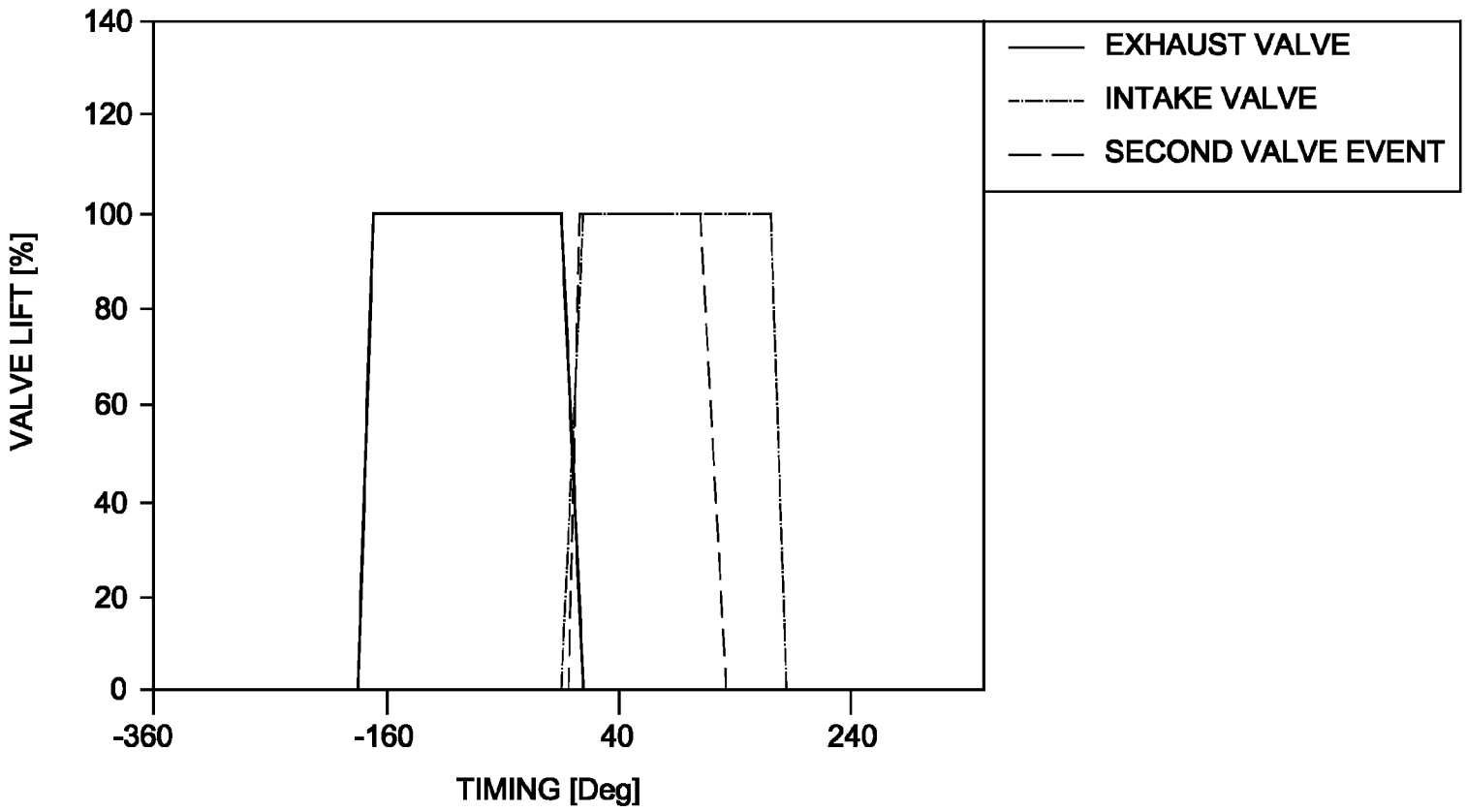
FIG. 12 is a graph illustrating a valve control strategy for switching between aggressive Miller cycle and non-aggressive Miller cycle or non-Miller cycle using the two-mode valve control mechanism of the invention by activating a secondary valve event close to an early intake valve closure (IVC), thereby extending the intake valve event for non-aggressive miller cycle or diesel cycle (non-Miller)
Figure 13:
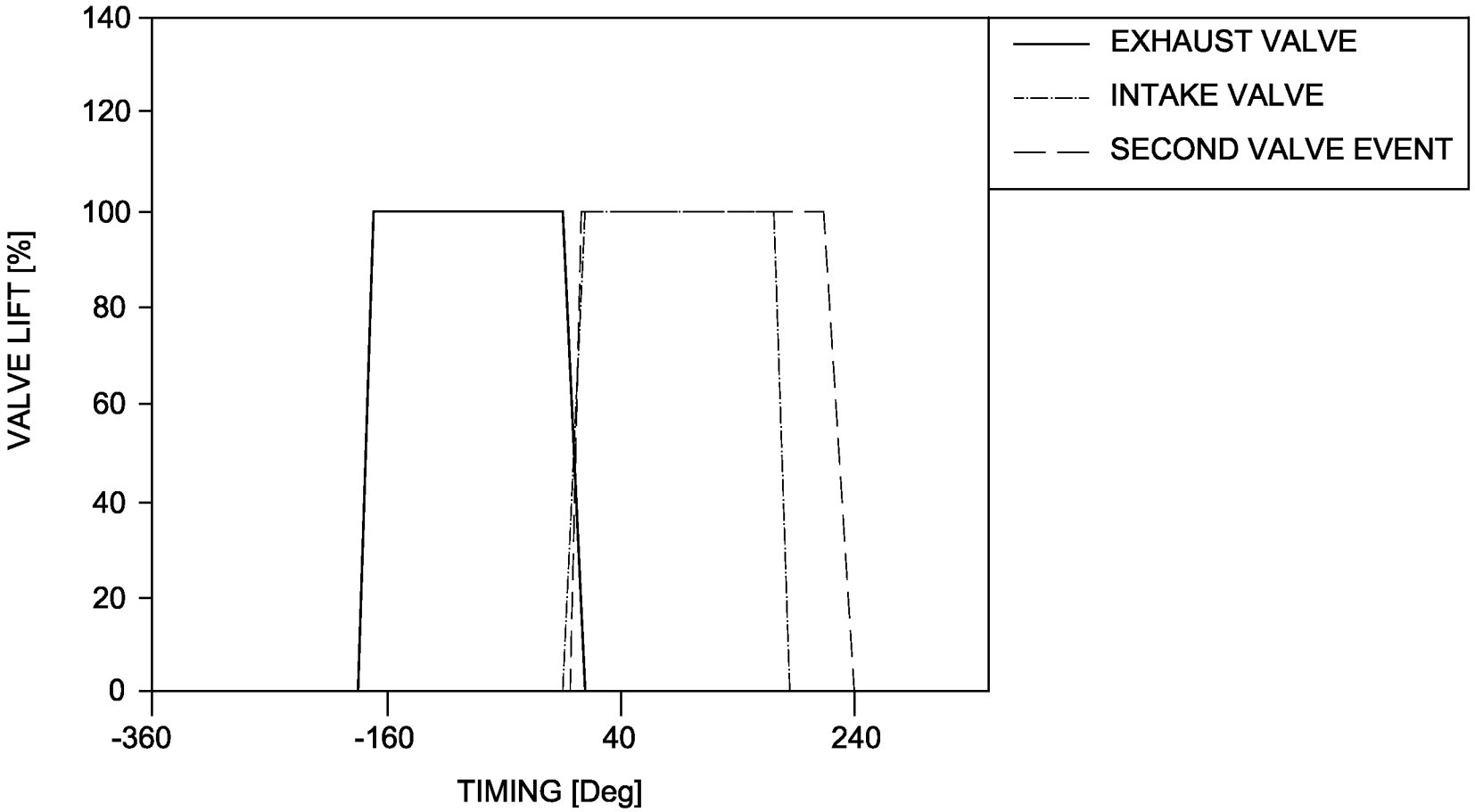
FIG. 13 is a graph illustrating a valve control strategy for switching between late intake valve closure Miller cycle and normal diesel cycle using the two-mode valve control mechanism of the invention by activating a secondary valve event during the early part of the compression stroke, thereby causing the main valve timing to close in the non-Miller fashion and to hold the valve open to facilitate the late IVC Miller cycle.

The problem of switching between aggressive Miller cycle and non-aggressive Miller cycle or aggressive Miller cycle and normal diesel cycle is solved by activating a secondary valve event which closes the intake valve later that with the primary valve event, or activating a secondary valve event during the early part of the compression stroke, as shown in FIGS. 12 and 13, respectively. In FIG. 12, the intake valve closure (IVC) occurs early (constituting early IVC Miller cycle), and the secondary valve can extend that valve event into a normal diesel cycle (non-Miller). In FIG. 13, the main valve timing closes in the non-Miller fashion and the additional valve event holds the valve open to facilitate the late IVC Miller cycle.

Figure 14:
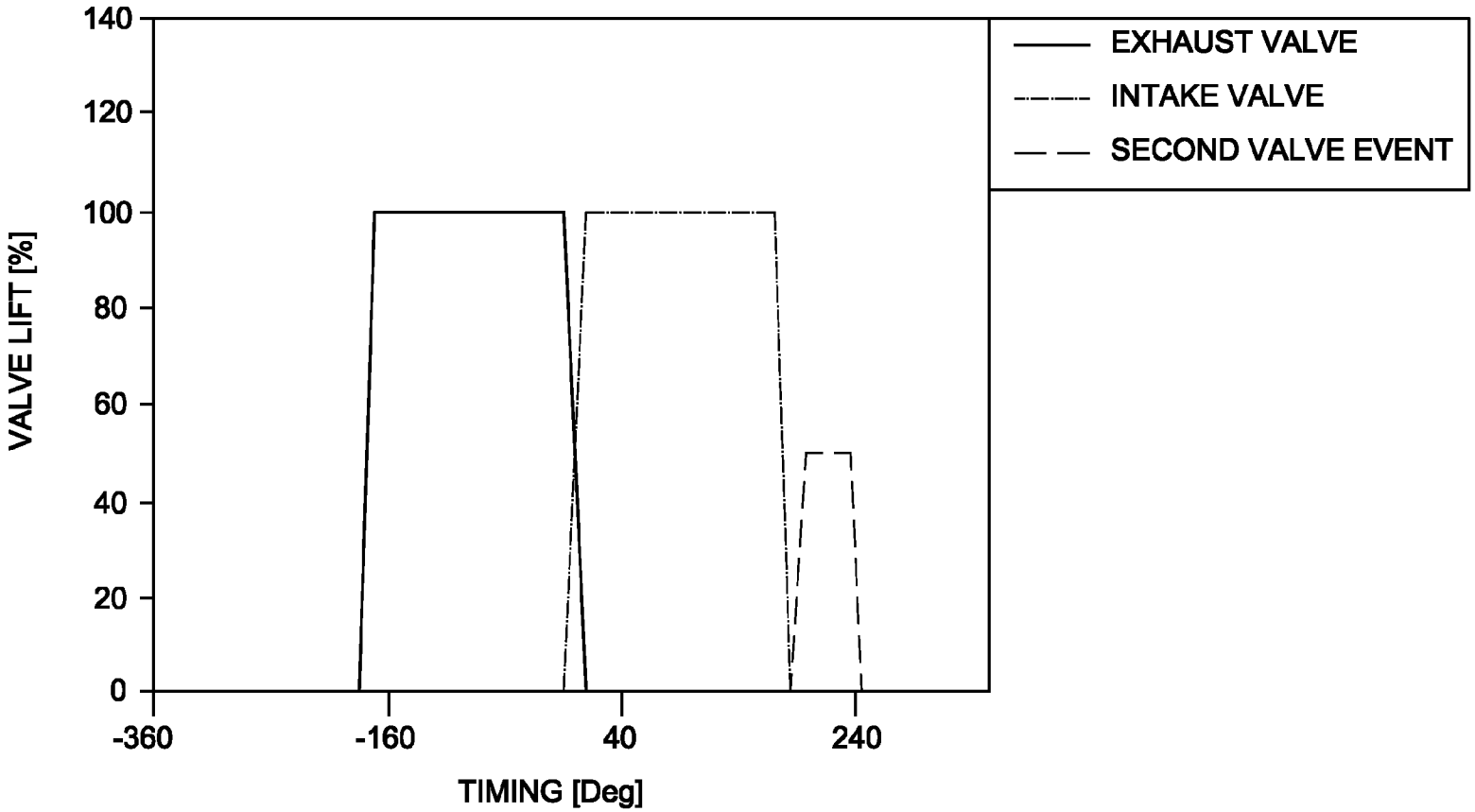
FIG. 14 is a graph illustrating a valve control strategy for switching between negative valve overlap operation for some conditions and standard operation (no negative valve overlap operation) for other conditions using the two-mode valve control mechanism of the invention by activating a secondary valve event to cause an overlap between the exhaust valve event and the intake valve event.

The problem of switching between negative valve overlap operation for some conditions and standard operation (no negative valve overlap operation) for other conditions is solved by activating a secondary valve event to cause an overlap between the exhaust valve event and the intake valve event, as shown in FIG. 14.

The problem of disabling some cylinders for certain operation schemes and enabling valve operation for other conditions is solved. This can be done using multiple valve methods. One method is to implement this system on the intake valves where the primary cam lobe is non-existent (i.e., does not actuate the valve) and the secondary cam lobe actuates the valve. Another valve strategy to disable a cylinder would be to turn the exhaust valves off using the non-existent primary lobe as described above while having the intake valves open during the intake stroke (using the primary lobe) and exhaust stroke (using the secondary lobe). To enable the cylinder, the exhaust valve is enabled using the secondary cam lobe for the exhaust cam and the intake valve is only actuated on the intake stroke (disabling the secondary lobe).

The technical advantages of the valve control mechanism 10 of the invention are that the valve lift profiles can be independently specified and will be insured. Even with the hydraulic system in which some leakage of the oil is expected, the secondary cam followers 14 can be designed to account for that leakage and provide whatever valve lift is desired. Other hydraulically actuated systems have a maximum valve lift that is limited by the so-called primary cam lift because the hydraulics attempt to catch the valve train at maximum lift, but compressibility and leakage cause this to be reduced. The commercial advantage to the mechanism 10 is that it enables very aggressive Miller cycle timings to be pursued at high load when high-pressure compressed air is readily available from the turbocharger. When at low loads when the turbocharger does not provide sufficient air pressure to enable aggressive Miller cycle, a less aggressive valve timing can be pursued allowing more air to be swallowed at a relatively low pressure. As a result, fuel economy and emissions can be optimized over a wider range of operating conditions. Other technical advantages, described above, enable advanced control schemes for alternate combustion modes or may enable disabling of individual cylinders as needed.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A multi-mode valve control mechanism for an engine, comprising:

a primary cam follower rotatably mounted within a mount and having one end engaging a camshaft;

one or more secondary cam followers rotatably mounted within a mount and having one end engaging the camshaft, each secondary follower including means for coupling and decoupling to the primary cam follower;

a shaft operably coupled to the mount for each of the one or more secondary cam followers; and a spring disposed about the shaft and positioned between the mount and a seat for exerting a biasing force on the secondary cam followers, wherein, in a first mode of operation, the primary cam follower is not operatively coupled to the one or more secondary cam followers in such a way that actuation of the one or more secondary cam followers will not actuate the primary cam follower, and wherein, in a second mode of operation, the primary cam follower is operatively coupled to the one or more secondary cam followers in such a way that actuation of the one or more secondary cam followers will also actuate the primary cam follower.

2. The control mechanism according to claim 1, wherein the coupling and decoupling means comprises a locking pin that is capable of being disposed within a cavity of the shaft.

3. The control mechanism according to claim 1, wherein the coupling and decoupling means comprises blocking a weep hole in fluid communication with a cavity of the shaft.

4. A multi-mode valve coupling mechanism for an engine, comprising:

a primary cam follower rotatably mounted within a mount and having one end engaging a camshaft;

one or more secondary cam followers rotatably mounted within the mount and having one end engaging the camshaft, each secondary cam follower operatively coupled to a shaft;

a shaft operably coupled to the mount for each of the one or more secondary cam followers; and a biasing member disposed about the shaft and positioned between the mount and a seat for exerting a biasing force therebetween, wherein a frequency and a duration at which valves in a valve train are actuated is changed by activating only the primary cam follower in a first mode of operation, or activating both the primary cam follower and one more than one secondary cam followers in a second mode of operation, depending on whether the coupling mechanism has been activated.

5. The coupling mechanism according to claim 4, wherein disposing a locking pin within a cavity of the shaft activates the coupling mechanism.

6. The coupling mechanism according to claim 4, wherein blocking a weep hole in fluid communication with a cavity of the shaft activates the coupling mechanism.

7. A method of modulating a valve event in an engine using a multi-mode valve control mechanism, the method comprising:

changing one of a frequency and a duration at which valves in a valve train are actuated by activating only a primary cam follower in a first mode of operation, or activating both the primary cam follower and at least one secondary cam followers in a second mode of operation, depending on whether the at least one secondary cam follower is decoupled or coupled to the primary cam follower, respectively.

8. The method according to claim 7, wherein the one or more secondary cam followers are actuated prior to actuation of the primary cam follower.

9. The method according to claim 7, wherein the one or more secondary cam followers are actuated subsequent to actuation of the primary cam follower.

10. The method according to claim 7, wherein the one or more secondary cam followers are actuated while the primary cam follower is actuated.

11. The method according to claim 7, wherein the one or more secondary cam followers are actuated for a longer period of time than the primary cam follower.

12. The method according to claim 7, wherein the one or more secondary cam followers are actuated for a shorter period of time than the primary cam follower.

* * * * *